United States Patent [19]

Kuhlengel

[11] Patent Number: 5,028,764

[45] Date of Patent: Jul. 2, 1991

[54] CALCULATING INSTRUMENT AND METHOD THEREFOR

[76] Inventor: Roy Kuhlengel, 10440 Vah Ki Inn Rd., Coolidge, Ariz. 85228

[21] Appl. No.: 527,064

[22] Filed: May 22, 1990

[51] Int. Cl.[5] ..... B43K 29/08

[52] U.S. Cl. ..... 235/64; 235/79.5; 235/87 R

[58] Field of Search ..... 235/64, 79.5, 87 R

[56] References Cited

U.S. PATENT DOCUMENTS

| | | | |
|---|---|---|---|
| 2,158,431 | 5/1939 | Sanders | 235/87 R |
| 2,261,818 | 12/1941 | Reese | 235/87 R |
| 2,646,220 | 7/1953 | Weiser | 235/64 X |
| 2,777,636 | 1/1987 | Weiser | 235/64 X |

*Primary Examiner*—Benjamin R. Fuller
*Attorney, Agent, or Firm*—Harry M. Weiss

[57] ABSTRACT

A calculator for doing multiplication having an integral ball point pen. The calculator includes a ball point pen, an inner cylinder fixedly connected to the ball point pen, and an outer cylinder angularly displaceable relative to the inner cylinder. The inner cylinder has an outer surface which has a peripheral row of multiplier numbers and a plurality of axial rows of product numbers. The outer cylinder has a window for viewing and choosing a multiplier number and an axial slot for viewing the corresponding row of product numbers. The outer cylinder has an axial column of numbers to be multiplied which are disposed alongside the slot.

5 Claims, 1 Drawing Sheet

CALCULATING INSTRUMENT AND METHOD THEREFOR

BACKGROUND OF THE INVENTION

1. Field of Invention

The invention generally relates to a calculating instrument and method therefor and in particular the invention relates to a hand-held calculating and method therefor instrument having a writing unit.

2. Description of the Prior Art

The prior art calculating instrument includes a lower disk having numerals on one face and an upper disk having a window and being rotatable about a connecting pin relative to the lower disk.

One problem with the prior art calculating instrument is the difficulty of operating the calculating instrument and immediately thereafter writing down a calculated numeral.

SUMMARY OF THE INVENTION

According to the present invention, a calculator and method therefor is provided. The calculator comprises a writing unit, an inner cylinder enclosing the writing unit and fixedly connected thereto, an outer cylinder enclosing the inner cylinder and rotatable relative thereto. The inner cylinder has a display on the outer surface which includes a row of multiplier numbers and a plurality of columns of product numbers. The outer cylinder has a small window for viewing one of the set numbers, a vertical column of numbers to be multiplied, and a vertical slot for viewing the one vertical column of product numbers corresponding to the one set of multiplier number.

By using the combination of the writing instrument and inner cylinder and outer cylinder, the difficulty of operating the calculating instrument and immediately thereafter writing down a calculated numeral is minimized.

The foregoing and other objects and advantages will be apparent from the following description of the preferred embodiment of the invention as illustrated in the accompanying drawings.

DESCRIPTION OF THE PREFERRED EMBODIMENT

Figure 1:
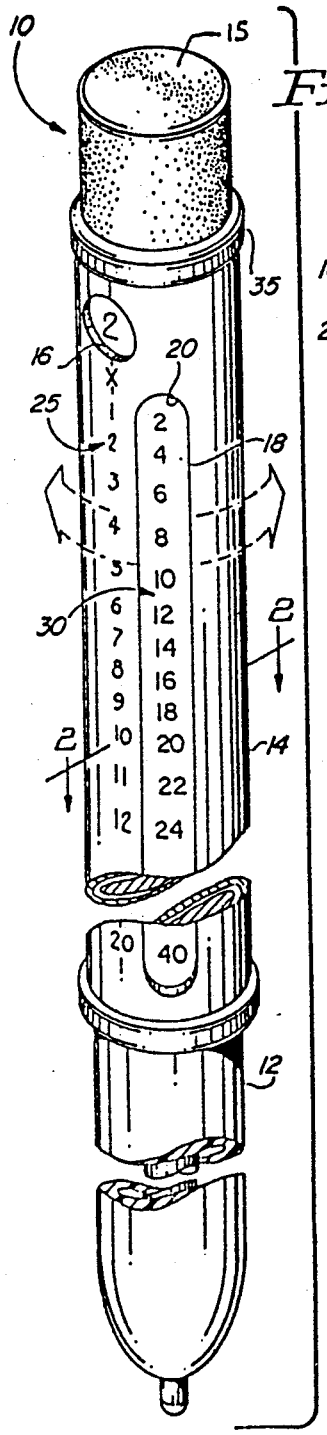
FIG. 1 is a perspective view of a calculating instrument according to the subject invention.
Figure 2:
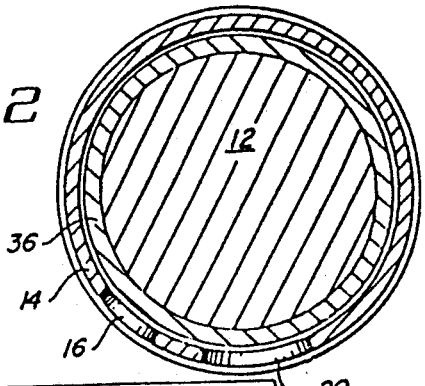
FIG. 2 is a section view taken along the line 2—2 of FIG. 1.
Figure 3:
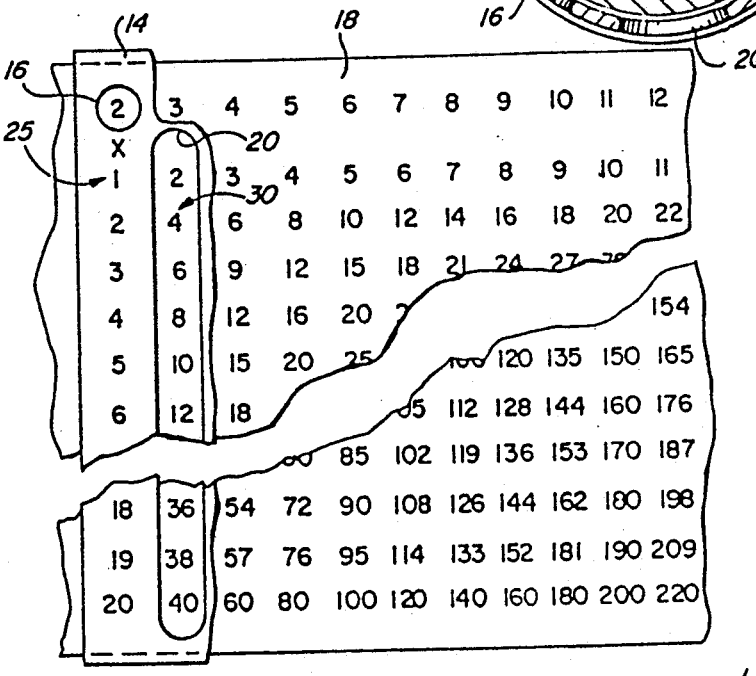
FIG. 3 is an enlarged view of a portion of FIG. 1.

As shown in FIG. 1, a calculating instrument or calculator 10 is provided. Calculator 10 includes a pen unit 12 with a cap 15, an inner sleeve or inner cylinder 36, and an outer housing or outer cylinder 14. Pen unit 12 is a ball-point pen unit. Outer cylinder 14 has a relatively small, circular window 16. Inner cylinder 36 has a panel or display 18 on its outer surface. Preferably, display 18 has a horizontal row of multiplier numbers ranging from 2–12. Display 18 also includes a plurality of vertical columns of product numbers. Window 16 is used to view the horizontal row of multiplier numbers. Outer cylinder 14 has a vertical opening or slot 20, which is used to view one vertical column of product numbers 30 that corresponds to the multiplier number in window 16. Outer cylinder 14 has one vertical column of numbers 25, which are numbers to be multiplied. Such column of numbers 25 to be multiplied is disposed vertically below and axially spaced from window 16.

Figure 4:
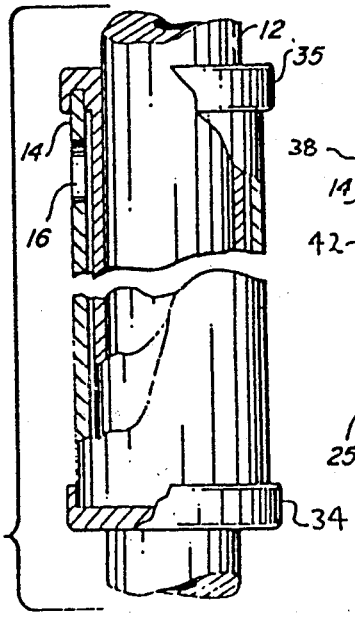
FIG. 4 is a partly cutaway, elevation view of a portion of FIG. 1.
Figure 5:
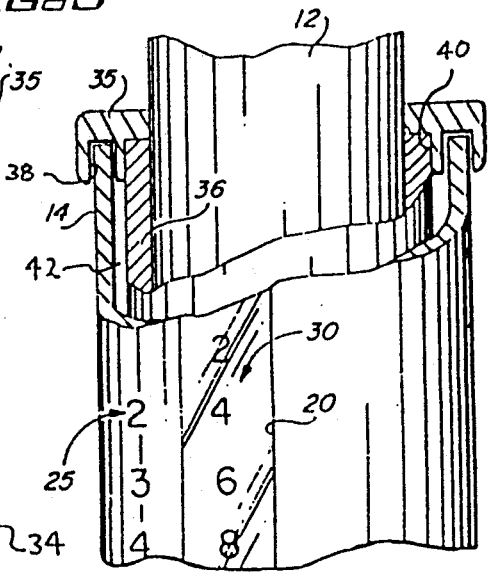
FIG. 5 is an enlarged view of a portion of FIG. 4.

Inner cylinder 36 has a bottom flange 34 and a top flange 35, which are identical in construction. Top flange 35, as shown in FIG. 4, has an outer cylindrical groove 38 and an inner cylindrical groove 40. Inner cylinder 36 is separated from outer cylinder 14 by an annular gap 42.

Inner cylinder 36 is fixedly connected to top flange 35 and bottom flange 34. Groove 40 of flange 35 is press fit over one end edge of inner cylinder 36. Flanges 34, 35 are each fixedly connected to and press fit over an outer surface of pen unit 12. A groove (not shown) of flange 34 is press fit over an opposite end edge of cylinder 36. Outer cylinder 14 is rotatable relative to inner cylinder 36 and pen unit 12. Outer groove 38 is loosely fit over an end edge of outer cylinder 14, so that outer cylinder 14 can be easily rotated relative to inner cylinder 36 and to flanges 34, 35. An outer groove (not shown) of flange 34 is also loosely fit over an opposite end edge of outer cylinder 14.

In use, window 16 is set over the desired multiplier number. The vertical column of numbers 25 are the numbers to be multiplied by the multiplier number, which was set in window 16. The vertical column of numbers 30 within slot 20 are the numbers, which are the corresponding product numbers resulting from the multiplication of the window number by the vertical column of number 25.

In the process of manufacture of calculator 10, top flange 35 in first slid axially over the outer surface of pen unit 12. Flange 35 and pen unit 12 have a press fit. Inner cylinder 36 is then slid axially over pen unit 12. Inner cylinder 36 has a press fit in groove 40 of top flange 35. Outer cylinder 14 is then slid axially over inner cylinder 36. Outer groove 38 of top flange 35 loosely receives the top edge of outer cylinder 14. A loose fit in an outer groove 38 allows nearly frictionless angular displacement of outer cylinder 14 relative to inner cylinder 36 by the fingers of a user. In this way, a user can readily set a number in window 16. Bottom flange 34 is then slid axially over the outer surface of pen unit 12. The groove of bottom flange 34 corresponding to groove 40 is press fit on inner cylinder 36. The groove of bottom flange 34 corresponding to outer groove 38 has loose fit with an adjoining edge of outer cylinder 14.

The advantage of calculator 10 are indicated hereafter.

A) The difficulty of operating calculator 10, and immediately thereafter writing down a calculated numeral is minimized.

B) Calculator 10 is useful to a child who is learning to use a multiplication table.

While the invention has been described in its preferred embodiment, it is to be understood that the words which have been used are words of description rather than limitation and that changes may be made within the preview of the appended claims without departing form the true scope and spirit of the invention in its broader aspects.

For example, window 16 and slot 20 can have magnifying glass panes.

As another example, writing unit 12 can be a pencil unit, instead of a ball-point pen unit.

I claim:

1. A calculator comprising:

an elongate writing unit with an axis;

an inner cylinder fixedly connected to the elongate writing unit coaxially therewith;

said inner cylinder having a display disposed on an outer surface thereof;

said display including an inner peripheral row of numbers and including a plurality of inner axial columns of numbers;

said inner peripheral row of numbers having a peripheral spacing and said plurality of inner axial columns of numbers having a peripheral spacing which is equal to the inner peripheral spacing of the inner peripheral row of numbers;

an outer cylinder disposed radially outwardly of the inner cylinder coaxially therewith;

said outer cylinder having a window for viewing one number of the inner peripheral row and having a slot for viewing one inner axial column; and said outer cylinder having an outer axial column of numbers disposed alongside the slot, said inner axial column having an axial spacing and said outer axial column having an axial spacing which is equal to the inner axial spacing.

2. The calculator of claim 1, wherein said window is aligned in an axial direction with the outer axial column of numbers.

3. The calculator of claim 1, wherein said writing unit is a ball-point pen unit.

4. The calculator of claim 1, wherein said inner peripheral row of numbers are multiplier numbers, said outer axial column of numbers are numbers to be multiplied, and said plurality of inner axial columns of numbers are product numbers.

5. A method for making a calculator comprising the steps of:

sliding axially a top flange over an outer surface of a writing unit using a press fit;

sliding an inner cylinder over the outer surface of the writing unit using a press fit;

press fitting a top edge of the inner cylinder in an annular inner groove in the top flange;

sliding an outer cylinder over an outer surface of the inner cylinder;

providing an annular gap between an inner surface of the outer cylinder and the outer surface of the inner cylinder;

loosely fitting a top edge of the outer cylinder in an annular outer groove of the top flange;

sliding axially a bottom flange over the outer surface of the writing unit;

press fitting a bottom edge of the inner cylinder in an annular bottom inner groove in the bottom flange; and loosely fitting a bottom edge of the outer cylinder in an annular bottom outer groove in the bottom flange.

* * * * *